United States Patent [19]

Schoettle et al.

[11] 4,198,007

[45] Apr. 15, 1980

[54] SHAFT FOR SIMULTANEOUSLY WINDING A PLURALITY OF ROLLS OF STRIP MATERIAL

[75] Inventors: Klaus Schoettle, Heidelberg; Peter Dobler, Ludwigshafen; Lothar Gliniorz, Frankenthal; Heinz Brombach, Oberkirch-Stadelhofen; Dieter Wöppel, Waldsee, all of Fed. Rep. of Germany

[73] Assignee: BASF Aktiengesellschaft, Fed. Rep. of Germany

[21] Appl. No.: 927,610

[22] Filed: Jul. 24, 1978

[30] Foreign Application Priority Data

Aug. 3, 1977 [DE] Fed. Rep. of Germany ..... 2734978

[51] Int. Cl.[2] ..... B65H 19/04; B65H 75/34; B65H 17/02

[52] U.S. Cl. ..... 242/56.9; 242/64; 242/68

[58] Field of Search ..... 242/56.9, 64, 68, 129.6, 242/46.2

[56] References Cited

U.S. PATENT DOCUMENTS

| | | | |
|---|---|---|---|
| 757,921 | 4/1904 | Haycraft | 242/68 |
| 777,981 | 12/1904 | Sterling | 242/68 |
| 2,431,130 | 11/1947 | Luchansky | 242/56.9 |
| 3,430,892 | 3/1969 | Heumann | 242/46.2 X |
| 3,554,457 | 1/1971 | Hutzenlaub | 242/56.9 |

*Primary Examiner*—Edward J. McCarthy
*Attorney, Agent, or Firm*—Keil & Witherspoon

[57] ABSTRACT

A winding shaft having a plurality of winding sleeves which are mounted next to one another on the winding shaft in such a way that they can rotate independently of one another, and which can be frictionally connected thereto, the frictional connections between the winding sleeves and the winding shaft being independently adjustable, and the parts exposed to friction being slow-wearing and the device being producible at low cost.

5 Claims, 11 Drawing Figures

Figure 6A:
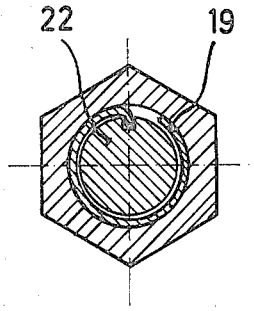

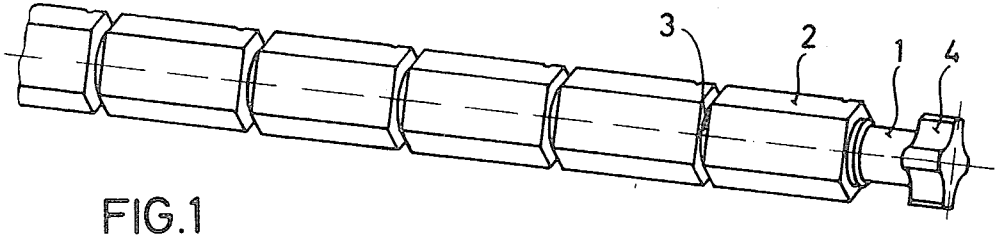
FIG.1
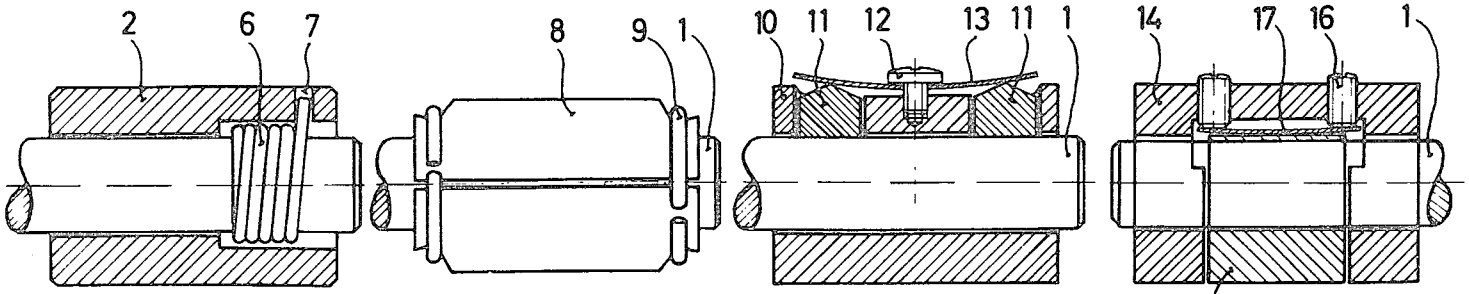
FIG.2
FIG.3
FIG.4
FIG.5

SHAFT FOR SIMULTANEOUSLY WINDING A PLURALITY OF ROLLS OF STRIP MATERIAL

The present invention relates to a winding shaft having a plurality of winding sleeves which are mounted next to one another on the winding shaft in such a way that they can rotate independently of one another, and which can be frictionally connected thereto, which shaft is used for simultaneously winding a plurality of rolls of strip material under uniform tension.

A winding shaft of this type is disclosed in German Pat. No. 1,143,074, according to which the winding sleeves can be coupled by means of clamping elements to flanged rings, and radially movable pressure elements, arranged on the shaft, can be urged against the inside surfaces of the flanged rings. Frictional contact between the individual clamping elements and the winding sleeves is produced by means of an axially displaceable sleeve which presses the flanged rings jointly up against an adjustment ring or collar on the shaft. Separate adjustment of the frictional connections between these individual winding sleeves is therefore not possible. Besides, when the winding shaft rotates at high speed and there is considerable slip between the clamping elements and the winding sleeves, rapid wear of the clamping elements may occur because they are made of a resilient material to enable frictional contact to be made. A further disadvantage is that the design and construction of the winding shaft is complex and expensive.

An object of the present invention is to so design a winding shaft with winding sleeves that the frictional connections between the winding sleeves and the winding shaft can be adjusted independently of one another and that the parts subjected to friction wear as slowly as possible. A further object of the invention is to make this device for transmitting frictional force more economical to manufacture than prior art devices of this type.

These objects are achieved according to the present invention by a winding shaft having a plurality of winding sleeves which are mounted next to one another on the winding shaft in such a way that they can rotate independently of one another, and which can be frictionally connected thereto, for simultaneously winding a plurality of rolls of strip material, wherein to each winding sleeve there is allocated a spring element by means of which frictional connections between the winding shaft and the winding sleeves can be established.

The winding shaft of the present invention has proved to be particularly advantageous for driving the hubs of a plurality of juxtaposed magnetic tape cassettes, on which hubs magnetic tapes are to be wound. By means of spring elements it is possible to set for every winding sleeve engaging the toothed central aperture of a hub, the maximum permissible tension of the magnetic tape beyond which the winding sleeve is no longer rotated by the winding shaft. There is no frictional connection between adjacent winding sleeves, so that the sleeves can rotate independently of one another. This prevents, for example, in the event of one of the hubs seizing, the tape winding operation in the case of all the other cassettes from being interrupted or disturbed. Another advantage is that the winding sleeve provided by the invention consists of only a few, simple parts for which materials can be employed which are highly resistant to wear.

Figure 6:
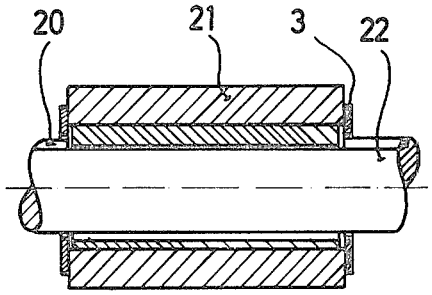
Figure 7A:
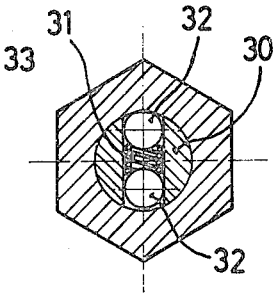
Figure 7:
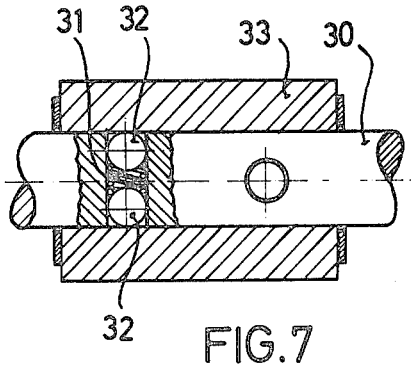
Figure 8A:
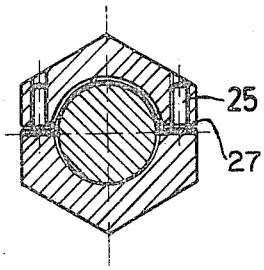
Figure 8:
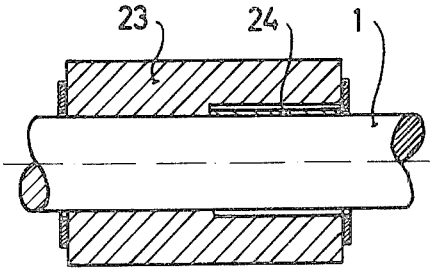

Further details of the invention are disclosed in the following description of the embodiments of the winding shaft illustrated in the accompanying drawings, in which FIG. 1 is a general perspective view of part of the winding shaft designed according to the invention, FIGS. 2–8 show, in longitudinal section, various embodiments of winding sleeves mounted on the winding shaft, and FIGS. 6*a*, 7*a* and 8*a* are cross-sectional views of the embodiments of FIGS. 6, 7 and 8 respectively.

The winding sleeves 2 which consist of a plastics material, preferably polyoxymethylene, are mounted next to one another on the winding shaft 1, 22, 30 in a freely rotatable manner. To avoid the transmission of rotary movement from one winding sleeve to an adjacent winding sleeve, annular spacers 3 are inserted between the individual winding sleeves 2, 8, 10, 14, 21, 23, 33. Suitable materials of construction for the winding shaft 1, 22, 30 are hard metals, preferably case-hardened steel. The winding sleeves 2, 8, 10, 14, 21, 23, 33 may themselves take up the material to be wound, or they may be used to drive reels, for example the hubs of magnetic tape cassettes. In the latter case, the cross-sectional profile of the winding sleeves 2, 8, 10, 14, 21, 23, 33 is matched to the central aperture of the reel to be driven; in the embodiments described here this profile is hexagonal. One end of the winding shaft 1, 22, 30 is provided with a drive member, e.g. a pulley or, as shown in FIG. 1, a cross-shaped head for a drive motor. The other end of the shaft is provided with a centering portion, not shown in the drawing. FIGS. 2 to 8 show various embodiments of winding sleeves with spring elements in frictional contact with the winding shaft which is shown broken.

According to FIG. 2, the central bore in the winding sleeve 2 is enlarged at one end to receive a helical spring 6 which fits on the winding shaft 1. The helical spring 6 is fixed at one end in a radial bore 7 in the winding sleeve. The desired frictional force and hence the maximum torque to be transmitted to the winding sleeve 2 by the winding shaft 1 depends upon the number of turns, the wire diameter and the force of the helical spring 6. For a torque of 0.80 Ncm for example, the shaft diameter being 4 mm and the helical spring having 3 to 5 turns and a wire diameter of 0.5 mm, the internal diameter of the spring is $3.7 \pm 0.02$ mm. To limit the torque to be transmitted, the helical spring 6 is fitted on the winding shaft 1 in such a way that it uncoils upon rotation of the winding shaft 1, under the action of the frictional force. Due to the increasing internal diameter of the helical spring 6, the frictional force decreases.

In another embodiment shown in FIG. 3, the winding sleeve 2 consists of two members 8 of semicircular cross-section which are held together at their constricted ends by clamping rings.

FIG. 4 shows an embodiment in which the winding sleeve 10 has two apertures in each of which a clamping member 11 is guided. The two clamping members 11 are urged against the winding shaft 1 by means of a leaf spring 13. The force with which they bear against the shaft and hence the frictional force is adjusted by means of a screw 12 which fastens the leaf spring 13 to the central portion of the winding sleeve 10.

The winding sleeve 14 illustrated in FIG. 5 likewise comprises a leaf spring 17, the spring force in this case being set by means of two adjustment screws 16, which spring urges a segment 15 against the winding shaft 1, the segment being loosely arranged in the central portion of the winding sleeve 14.

According to the embodiment shown in FIGS. 6 and *6a*, the winding shaft 22 is surrounded by a sleeve-like spring 19 in the form of a cylinder cut open along a generatrix, a bent-over edge of which cylinder is fixed in a corresponding groove 20 in the winding shaft 22. Due to its outwardly acting force, the spring 19 shaped in this way bears with its outer surface against the inner surface of the winding sleeve 21 and thus establishes the frictional connection between winding shaft 22 and winding sleeve 21. Obviously, this arrangement can also be reversed, i.e. the spring is provided with an outwardly bent edge which is fixed in a groove in the winding sleeve, and embraces the winding shaft due to the inwardly acting spring force. This embodiment is not illustrated in the drawings.

In another embodiment (cf. FIGS. 7 and *7a*), the winding shaft 30 is provided with a radial bore, and a helical spring 31 is accommodated in this bore. This spring urges two hardened steel balls 32 against the inner surface of a winding sleeve 33 which, in this case, preferably consists of bearing metal. In practice, the design of this embodiment will be such that two or more radial bores displaced relative to one another by 90° and uniformly distributed over the length of the winding sleeve 33 are provided with springs 31 and steel balls 32. This guarantees smooth running of the winding sleeve 33.

Another possibility of establishing a frictional connection between the winding sleeve and the winding shaft is shown in FIGS. 8 and *8a*. Here, a semicircular spring band 24 with bent ends 27 constitutes the spring element transmitting the frictional force. So that the latter can be accommodated between winding shaft 1 and winding sleeve 23, the central bore of the winding sleeve 23 comprises an enlarged semi-circular portion, and a slot is provided in the median plane of the winding sleeve. By means of adjustment screws 25 which can be rotated in the threaded bores in the winding sleeve, the spring band 24 can be urged, via its bent ends 27, against the periphery of the winding shaft 1 in order to set up the desired frictional force.

We claim:

1. A device for winding a plurality of rolls of strip material under uniform pressure which comprises:

a shaft;

a plurality of independently rotatable winding sleeves mounted on said shaft, each of said sleeves including a radial bore; and springs frictionally connecting each of said sleeves to said shaft, said springs being helically wound about said shaft in a manner such that friction between the springs and the shaft tends to uncoil the springs as the shaft is rotated, one end of the springs being fixed in the radial bore of the sleeves.

2. A device for winding a plurality of rolls of strip material under uniform pressure which comprises:

a shaft;

a plurality of independently rotatable winding sleeves mounted on said shaft, each of said sleeves including one or more apertures communicating with the shaft;

clamping means seated in the apertures of said sleeves and positioned to apply frictional force against the shaft;

leaf springs in contact with said clamping means; and screw means for adjusting the force exerted by the leaf springs against the clamping means.

3. A device for winding a plurality of rolls of strip material under uniform pressure which comprises:

a shaft;

a plurality of independently rotatable winding sleeves mounted on said shaft, said sleeves including longitudinal slots;

a semi-circular spring positioned for functional contact with the shaft, said spring having bent ends located in the longitudinal slots of the sleeve; and screw means in contact with the bent ends of the spring for adjusting the pressure exerted by the spring against the shaft.

4. A device for winding a plurality of rolls of strip material under uniform pressure which comprises:

a shaft having a longitudinal groove;

a plurality of independently rotatable winding sleeves mounted on the shaft; and a sleeve-like spring between the shaft and the sleeves which bears against the inner surface of the winding sleeves, one end of the spring being fixed in the groove of the shaft.

5. A device for winding a plurality of rolls of strip material under uniform pressure which comprises:

a shaft having a radial bore;

a plurality of independently rotatable winding sleeves mounted on the shaft; and friction means within said radial bore of the shaft consisting of two balls and a helical spring located therebetween, which spring urges the two balls against the inner surface of the winding sleeve.

* * * * *